United States Patent [19]

Iwata

[11] Patent Number: 5,026,263

[45] Date of Patent: Jun. 25, 1991

[54] ROTARY VANE PUMP WITH VALVE TO CONTROL VANE BIASSING

[75] Inventor: Hiroto Iwata, Saitama, Japan

[73] Assignee: Jidosha Kiki Co., Ltd., Tokyo, Japan

[21] Appl. No.: 441,036

[22] Filed: Nov. 22, 1989

[30] Foreign Application Priority Data

Dec. 2, 1988 [JP] Japan ..... 63-305512

[51] Int. Cl.[5] ..... F04C 2/344; F04C 15/02

[52] U.S. Cl. ..... 418/82; 418/268

[58] Field of Search ..... 418/23, 82, 102, 268; 137/625.4; 251/325

[56] References Cited

U.S. PATENT DOCUMENTS 4,386,891 6/1983 Riefel et al. ..... 418/82
4,488,574 12/1984 Bartholomäus ..... 215/325
4,516,920 5/1985 Shibuya ..... 418/268

FOREIGN PATENT DOCUMENTS 3101516 8/1982 Fed. Rep. of Germany ..... 418/23
23097 2/1984 Japan ..... 418/23

*Primary Examiner*—Leonard E. Smith
*Assistant Examiner*—David L. Cavanaugh
*Attorney, Agent, or Firm*—Flynn, Thiel, Boutell & Tanis

[57] ABSTRACT

An oil pump of vane type is disclosed. Plates which hold a rotor and a cam ring therebetween have a groove formed in their suction region to allow a discharged oil to be introduced into such groove. The plates are also formed with a groove in their discharge region which communicates with the groove in the suction region through an orifice. The oil in these grooves act upon the back side of the vane to urge it into abutment against the cam ring. A passage is provided for connecting the groove in the discharge region to a low pressure side of the pump, and a valve opens or closes the passage to enable the pumping action to be turned on and off.

4 Claims, 3 Drawing Sheets

ROTARY VANE PUMP WITH VALVE TO CONTROL VANE BIASSING

BACKGROUND OF THE INVENTION

The invention relates to an oil pump, and more particularly, to an oil pump, the pumping action of which can be turned on and off as required.

An oil pump of vane type generally comprises a cam ring having a substantially elliptical cam surface around its inner periphery, a rotor disposed for rotation inside the cam ring, a plurality of vanes fitted in the rotor for reciprocating motion in their associated radially extending slits, and a pair of pressure plate and side plate which act to hold the rotor and the cam therebetween from the opposite sides. As the rotor rotates, the volume of a pump chamber defined between a pair of adjacent vanes increases and decreases, thus serving the suction and discharge of oil. In order to achieve a reliable sliding contact of the vane tip with the cam, a groove is formed in the pressure plate to introduce oil which is discharged from the pump chamber so as to act against the back side of the vane.

When the described oil pump is mounted on a vehicle, the pumping action must be turned on and off as desired. In the prior art practice, the turn-on and-off of the pumping action has been achieved by means of a clutch were the pump is driven from an associated engine through a belt, or by turning an electric motor on and off where the pump is driven by such motor. However, the prior art arrangement incorporating such clutch or motor is bulky and is also disadvantageous in respects of control, reliability and costs.

SUMMARY OF THE INVENTION

Therefore, it is an object of the invention to provide an oil pump, the pumping action of which can be turned on and off with a simple construction.

Other objects and advantages of the invention will become apparent from the following description of an embodiment thereof with reference to the attached drawings.

BRIEF DESCRIPTION OF THE DRAWINGS

FIG. 1 is a longitudinal section of an overall arrangement;

FIG. 2 is a front view of a pump cartridge.

FIG. 3 is a front view of a rear body;

FIG. 4 is a schematic view illustrating a solenoid valve in operation; and

FIG. 5 is an enlarged view of an area A encircled in FIG. 2.

DESCRIPTION OF EMBODIMENT

Figure 1:
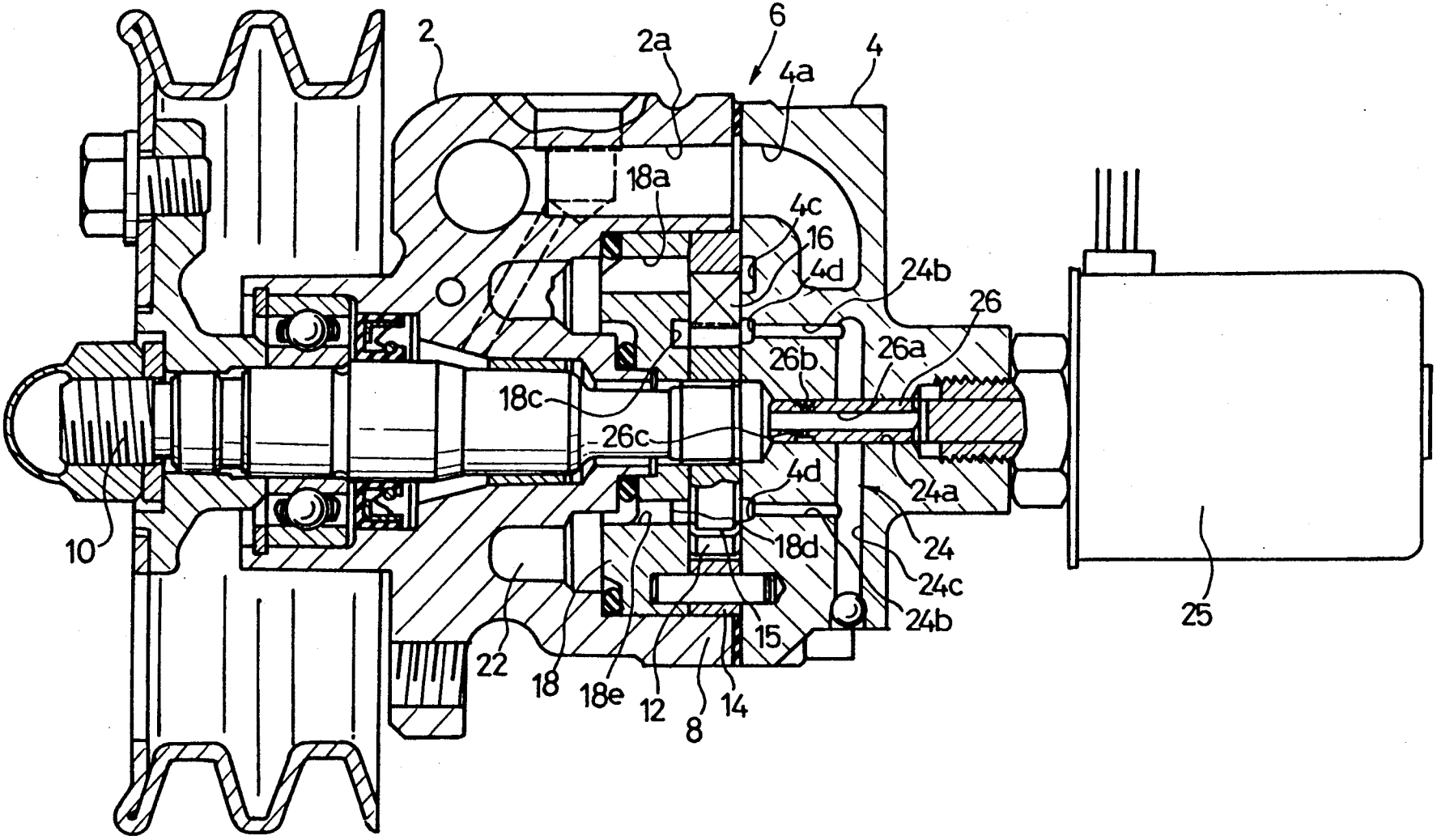
FIGS. 1 to 5 show an oil pump according to one embodiment of the invention; specifically

Referring to the drawings, an embodiment of the invention will now be described. FIG. 1 is a longitudinal section of an oil pump according to one embodiment of the invention in which a front body 2 and a rear body 4 are joined together to define a pump body 6 which receives a pump cartridge 8.

The pump cartridge 8 comprises a rotar 12 which is fitted in and connected with an axial bore formed in the inner end of an input shaft 10 which is inserted through the front body 2 for integral rotation therewith, a cam ring 14 disposed in surrounding reltionship with the rotor 12 and including a substantially elliptical cam surface formed around its inner periphery, and a plurality of vanes 16 which are disposed in a corresponding number of radially extending slits 15 formed in the rotor 12 for reciprocating motion in a manner such that their tip slidably contacts the inner surface of the cam ring 14. The rotor 12, the cam ring 14, and the vanes 16 are held between a pressure plate 18 which is disposed inside the front body 2 and the rear body 4, both disposed on the opposite sides thereof. When the rotor 12 is set in motion as the input shaft 10 rotates, the volume of each pump chamber defined by a pair of adjacent vanes 16 increases and decreases, thus drawing oil from a tank, not shown, through suction passages **2*a*, 4*a* formed in the pump body 6 and discharging it through a discharge port 18*a* formed in the pressure plate 18 into a discharge chamber 22 which is formed in the bottom of the front body 2**.

Figure 2:
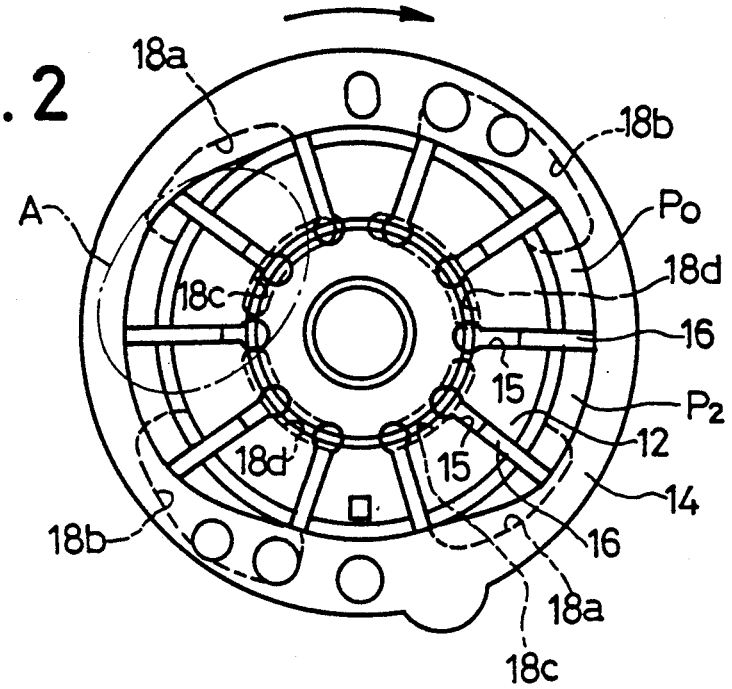
Figure 5:
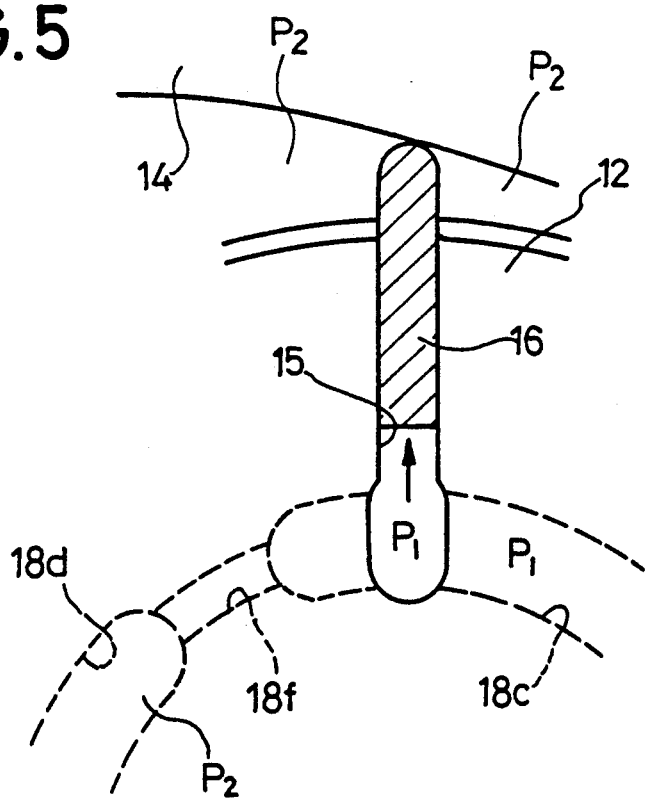

As shown in phantom line in FIG. 2, a pair of discharge ports **18*a* are formed to extend through the pressure plate 18 at points which are symmetrical to each other, and a pair of recesses 18*b* are formed at points 90 ° displaced from the discharge ports 18*a* so as to be located opposite to suction ports 4*b* (see FIG. 3) formed in the rear body 4. A pair of arcuate grooves 18*c* are formed radially inward of the both discharge ports 18*a* or in a discharge region of the pump cartridge 8, and another pair of arcuate grooves 18*d* are formed radially inward of the both recesses 18*b* or in the suction region of the pump cartridge 8, the arcuate grooves 18*c* and 18*d* being connected together through orifices 18*f* (see FIG. 5). The pair of grooves 18*d* located in the suction region communicate with the discharge chamber 22 through an opening 18*e*, whereby part of the oil which has been discharged into the discharge chamber 22 can be introduced into the groove 18*d* in the suction region through the opening 18*e*, thus maintaining the pressure within the groove equal to a discharge pressure. The groove also communicates with the groove 18*c* in the discharge region through the orifice 18*f*. Each of the grooves 18*c* and 18*d* communicates with the bottom of the radial slits 15 formed in the rotor 12 in which the vanes 16 are fitted, whereby the discharged oil which are introduced into the grooves 18*c* and 18*d* urges against the vane 16 from the bottom side of the slits 15 so that the tip of the vane 16 slidably engages the cam ring 14**.

Figure 3:
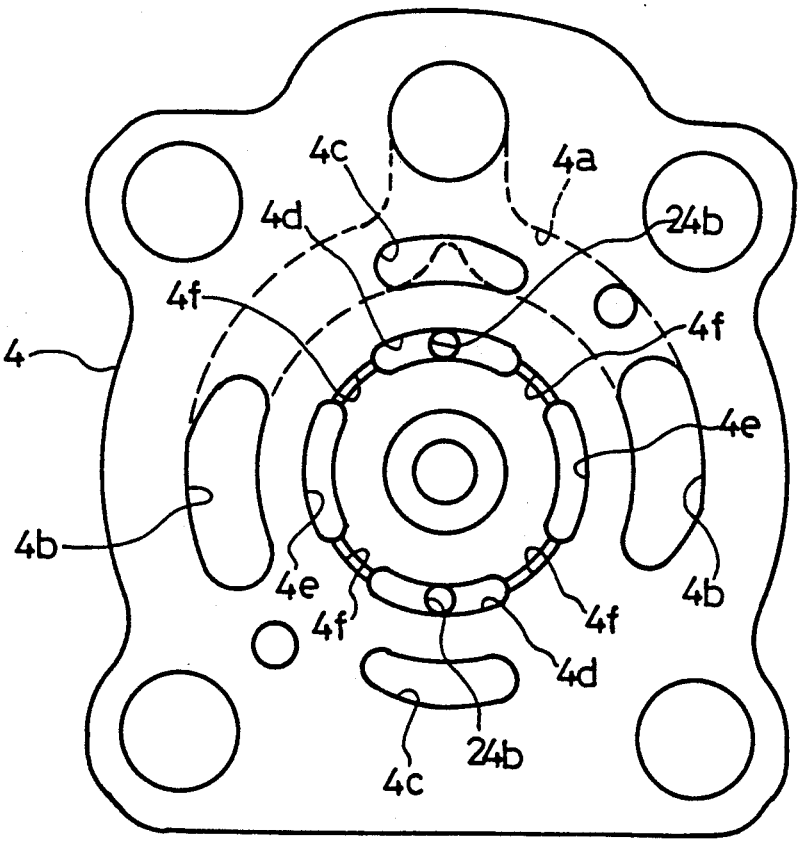

As shown in FIG. 3, the rear body 4 is formed with the pair of suction ports **4*b* where the suction passages 4*a* open into the pump cartridge 8, and also a pair of recesses 4*c* which are located opposite to the discharge ports 18*a* formed in the pressure plate 18. Grooves 4*d* in the discharge region and grooves 4*e* in the suction region are formed so as to be located opposite to the grooves 18*c* in the discharge region and the grooves 18*d* in the suction region of the pressure plate 18, and the grooves 4*d* and 4*e* are connected together through orifices 4*f***.

The grooves **4*d* formed in the discharge region of the rear body 4 can communicate with a space surrounding the input shaft 10 through a communication passage 24 formed within the rear body 4. The communication passage 24 includes a portion 24*a* extending through to the outside thereof in an axial alignment with the input shaft 10, another portion 24*b* extending parallel to the portion 24*a* from both of the grooves 4*d*, *e* and a further perpendicular portion 24*c* which provides a communication between both of the portions 24a and 24b (see FIG. 1**).

Figure 4:
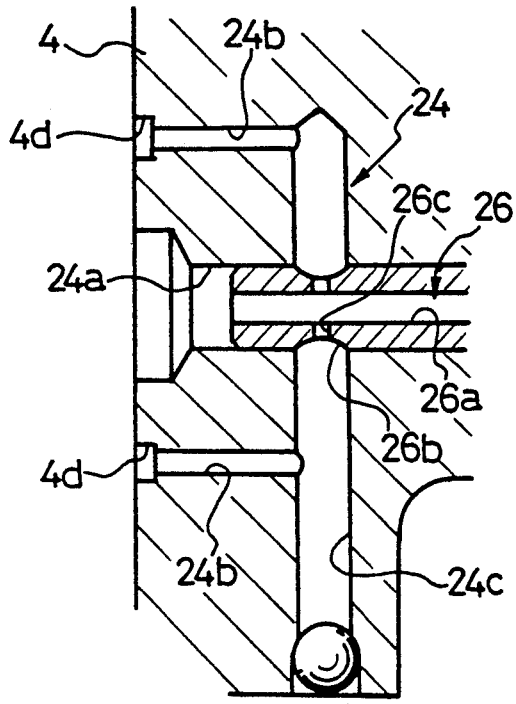

A solenoid 25 is fixedly mounted outside the portion 24a of the communication passage 24, and operates to reciprocate a valve 26 which is fitted in the portion 24a. Specifically, the valve 26 comprises an axial bore 26a, an annular groove 26b formed around its peripheral surface, and a radial bore 26 c providing a communication between the annular groove 26b and the bore 26a. When the valve 26 assumes its advanced position, the communication between the groove 4d in the discharge region and the space surrounding the input shaft 10 is interrupted as shown in FIG. 1 while when the valve 26 assumes its retracted position, the groove 4d communicates with the space surrounding the input shaft 10 through the parallel portion 24b and the perpendicular portion 24c of the communication passage 24, the annular groove 26b, the radial bore 26c and the axial bore 26a of the valve 26 and the portion 24a of the communication passage 24, as shown in FIG. 4.

OPERATION

The operation of the oil pump thus constructed will now be described. During a normal operation, the rotor 12 rotates in a direction indicated by an arrow in FIG. 2, and oil is drawn through the suction port 4b into each pump chamber defined by a pair of adjacent vanes 16 and discharged through the discharge port 18a. The pressure relationship which prevails at this time will be described with reference to FIG. 2 and FIG. 5 which shows the area A to an enlarged scale. Representing the pressure in the pump chamber of the suction region by Po and the pressure in the pump chamber of the discharge region by $P_2$, it will be understood that the discharge pressure $P_2$ will be introduced into the arcuate groove 18d of the suction region through the discharge chamber 22 and the opening 18e, whereby the pressure which prevails within the groove 18d will be equal to $P_2$. It will be noted that the same oil pressure is introduced into the grooves 4d and 4e in the rear body 4 which are located opposite to the grooves 18c and 18d in the pressure plate 18.

A lack of the orifices 18f and 4f in a pump structure will eventually cause the pressure on the radially inner side of the vanes to become equal to the discharge pressure $P_2$ at the radially outer side thereof. However, the grooves 18d and 4e in the suction region communicates with the arcuate groove 18c and 4d in the discharge region through the orifices 18f and 4f, but since each vane 16 is driven downward according to a change in a cam profile of the cam ring 14 within the discharge region, the oil in the grooves 18c and 4d of the discharge region will be displaced to pass through the orifices 18f and 4f into the grooves 18d and 4e in the suction region. Such flow of the oil from the grooves 18c and 4d in the discharge region to the grooves 18d and 4e in the suction region through the orifices 18f and 4f causes a pressure $P_1$ which prevails within the grooves 18c and 4d of the discharge region to be greater than the pressure $P_2$ which prevails in the grooves 18d and 4e of the suction region.

$$P_1 > P_2 \quad (1)$$

Accordingly, the vane 16 will be subject to the pressure $P_1$ on its radially inner or back side while it is loaded with the discharge pressure $P_2$ at its radially outer or front side. Since $P_1 > P_2$, this assures that the vane 16 be positively urged against the cam ring 14 to prevent an oil leakage.

When it is desired to cease the pumping action of the oil pump, an electric current is passed through the solenoid 25 to cause the valve 26 to be retracted. Thereupon, the condition illustrated in FIG. 4 prevails in which the groove 4d in the discharge region of the rear body 4 communicates with the space surrounding the input shaft 10. The space surrounding the input shaft 10 assumes a low pressure which is very close to the suction side pressure $P_0$, whereby the pressure $P_1$ in the groove 4d of the discharge region will assume a low pressure approaching the suction pressure $P_0$.

$$P_1 \approx P_2 \quad (2)$$

Since the discharge pressure $P_2$ is greater than the suction pressure $P_0$, the vane 16 will be driven downward to move away from the cam ring 14. As a consequence, there takes place no change in the volume of a pump chamber defined by a pair of vanes 16, thus ceasing the pumping action. Since a discharge pressure $P_2$ which slightly exceeds the suction pressure $P_0$ is sufficient to move the vane 16 away from the cam ring 14, the magnitude of the pressure $P_2$ will be greatly reduced, substantially reducing the driving torque.

The solenoid 25 can be controlled in response to a variety of signals such as the number of revolutions of an engine, a vehicle speed, a steering force, steering angle or the like depending on the intended use of the oil pump of the present embodiment.

In the described embodiment, the groove 4d in the discharge region is made to communicate with the space surrounding the input shaft 10 to release the oil pressure, but such pressure may be released to a tank or any other low pressure source. The orifices 4f and 18f which provide the communications between the grooves 4d and 18c in the discharge region and the grooves 4e and 18d in the suction region have been formed in both the pressure plate 18 and the rear body 4, but may be provided in only one of them. In the described embodiment, the rear body 4 also serves as a side plate, but a separate side plate may be disposed within the rear body.

From the foregoing, it will be seen that the invention provides a compact arrangement for an integrated pump, the pumping action of which can be turned on and off. Since the discharge from the pump cartridge is made equal to null, the torque consumption is only required to compensate for a frictional loss caused by the rotation, and can be reduced substantially to null. In addition, the arrangement has a simple construction, exhibits a high reliability and can be provided at a reduced cost.

Having described the invention in connection with a preferred embodiment thereof, it should be understood that the invention is not limited thereto, but that a number of changes, modifications and substitutions will readily occur to one skilled in the art therein without departing from the spirit and scope of the invention defined by the appended claims.

What is claimed is:

1. An oil pump having a pump housing, which oil pump is driven by a driven input shaft rotatably mounted in a space in the housing including a cam ring having a cam around its internal surface, a rotor disposed for rotation within the cam ring, a plurality of vanes disposed in radial slits formed in the rotor for reciprocating motion, wherein first and second plates are disposed on the opposite sides of the cam ring and the rotor to hold them therebetween, thus causing the volume of a pump chamber defined by a pair of adjacent vanes to change to perform an oil suction and discharge; wherein the first and second plates include a suction region where its pump chamber undergoes a suction stroke and in which a first groove is formed to allow discharged oil to be introduced thereinto directly, wherein the first and second plates also include a discharge region where each pump chamber undergoes a discharge stroke and in which a second groove is also formed, the first groove in the suction region and the second groove in the discharge region communicating with each other through an orifice to allow the oil in each first and second groove to act upon the back side of the vane in the slits to urge the vane into abutment against the cam, wherein there is provided a communication passage in the second plate which connects the second groove in the discharge region to a source of low pressure, and a valve for opening and closing the passage, and wherein the source of low pressure is the space surrounding the input shaft in the pump housing.

2. The oil pump according to claim 1, in which the communication passage includes a first portion extending in an axial alignment with an axis of the input shaft and communicating to a region radially outward from the input shaft, a second portion extending parallel the first mentioned portion and from both of the first and second grooves, and a perpendicular third portion providing a communication between the first portion and the second portion.

3. The oil pump according to claim 2, in which the valve comprises an axial bore, an annular groove formed around its outer peripheral surface and a radial bore providing a communication between the annular groove and the bore, the valve being slidably fitted in the first portion of the communication passage, the valve being adapted to move back and forth to establish and interrupt the communication between the first and second grooves in the discharge region of the rear body and the space surrounding the input shaft.

4. The oil pump according to claim 3, in which the valve is driven for reciprocating motion by a solenoid.

* * * * *